US010081528B2

(12) United States Patent
Romero

(10) Patent No.: US 10,081,528 B2
(45) Date of Patent: Sep. 25, 2018

(54) COMBINED BEVERAGE CONTAINER OPENER AND BEVERAGE BOTTLE RESEALER

(76) Inventor: Jerome Romero, Santa Fe, NM (US)

( * ) Notice: Subject to any disclaimer, the term of this patent is extended or adjusted under 35 U.S.C. 154(b) by 1912 days.

(21) Appl. No.: 11/881,545

(22) Filed: Jul. 27, 2007

(65) Prior Publication Data

US 2008/0023433 A1 Jan. 31, 2008

Related U.S. Application Data

(63) Continuation-in-part of application No. 10/641,971, filed on Aug. 15, 2003, now Pat. No. 8,720,714.

(51) Int. Cl.
*B67B 7/18* (2006.01)
*B67B 7/40* (2006.01)

(52) U.S. Cl.
CPC ..... *B67B 7/18* (2013.01); *B67B 7/403* (2013.01)

(58) Field of Classification Search
CPC ..... B67B 7/18; B67B 7/403
USPC ..... 215/354, 228, 302, 304, 295, 319, 303, 215/287, 334, 341, 305; 81/3.4, 488, 81/3.09, 3.15, 3.07; 7/170, 151; 220/254.1, 255, 212; D8/33, 34, 38, 40, D8/43; D9/436, 453
See application file for complete search history.

(56) References Cited

U.S. PATENT DOCUMENTS

| | | | | |
|---|---|---|---|---|
| 4,337,678 | A * | 7/1982 | Mumford | 81/3.4 |
| 4,455,894 | A * | 6/1984 | Roberts | 81/3.09 |
| 4,760,763 | A * | 8/1988 | Trick et al. | 81/3.09 |
| 4,829,618 | A * | 5/1989 | McKee | 7/151 |
| 5,483,854 | A * | 1/1996 | King et al. | 81/3.4 |
| D383,954 | S * | 9/1997 | Biunno | D8/40 |
| D399,108 | S * | 10/1998 | Koefelda | D8/38 |
| 5,893,301 | A * | 4/1999 | Hensley et al. | 81/3.09 |
| 6,374,419 | B1 * | 4/2002 | Pietsch | 2/209.13 |

FOREIGN PATENT DOCUMENTS

EP 0240930 A2 * 4/1987

* cited by examiner

*Primary Examiner* — Ernesto Grano
(74) *Attorney, Agent, or Firm* — Luis M. Ortiz; Kermit D. Lopez; Ortiz & Lopez, PLLC

(57) ABSTRACT

Beverage container opener and resealer includes a bottle cap remover including a circular bottle cap receiver and guide. Bottle cap receiver is formed of a generally inverted cup including therein teeth formed on the inner surface adapted to interface with a bottle cap to be twisted off of the bottle when the opener housing is maneuvered. Teeth can be provided in the form of ribs, flutes or ridges. The guide and teeth are receivable over the cap of a beverage container. Gripping material can extend into and/or downward onto a substantially complimentary surface formed on beverage container caps. A rubber bottle resealer reseals open bottles, thereby preserving the beverage. Module is configured to be integrated into and associated with a decorative three-dimensional decorative housing provided in the form of miniature headgear.

7 Claims, 4 Drawing Sheets

COMBINED BEVERAGE CONTAINER OPENER AND BEVERAGE BOTTLE RESEALER

PRIORITY TO PENDING APPLICATION

The present patent application claims priority as a Continuation-in-Part to U.S. patent application Ser. No. 10/641,971, filed by the present inventor on Aug. 15, 2003 now U.S. Pat. No. 8,720,714, and entitled "Combined Beverage Container Opener and Cover," the entire specification of which is also incorporated herein by reference.

FIELD OF THE INVENTION

The present invention relates to a multi-purpose device for opening various beverage containers, especially liquid containers such as drink bottles with twist-off or pop-off caps, and cans with lift-tab openers. The present invention also relates to a bottle resealing device. More particularly, the present invention relates to a combined multi-purpose beverage container opener and beverage bottle resealer device adapted for incorporation into and use with decorative 3-dimensional housing that can be hand held.

BACKGROUND

Beer and soft drink bottles with pop-off or twist-off caps, and cans with lift-tab openers are in relatively widespread use and tend to require a degree of manual dexterity and strength to be opened. Many individuals have difficulty in opening some or all of these containers without mechanical assistance, and frequently resort to makeshift implements (e.g., keys) in order to open a container. Opening a container such as a soda can may lead to fingernail damage. Oftentimes, a bottle cap opener is not available for use on pop-off caps and twist off caps that are difficult to open where arthritis, youth or seniority is a human factor.

There have been attempts in the past at addressing the need for all of the aforementioned problems through the provision of multi-purpose container opening devices. Examples of devices providing container opening capabilities are illustrated and described in the following U.S. patents: Utility U.S. Pat. No. 4,911,028; Des. 399,108; Des. 406,505; Des. 429,452; and Des. 432,375. The design patents illustrate aesthetic features for container openers that are miniature representations of sports headgear, such as football helmets, baseball helmets, and baseball caps. U.S. Pat. No. 4,911,038 describes utilitarian features for a multi-purpose container opener that can be found in the art.

Beverage containers are oftentimes served in establishments that are open to the public. For example, bars, nightclubs, sporting events all serve beverages. In bars and nightclubs, patrons are often concerned with misplacement or tampering of their drink. A misplaced drink must be replaced with the purchase of a new drink, which can be unfortunate where a substantial amount of beverage remained prior to the misplacement. The wait-staff (e.g., waiters, waitresses or bartenders) at the establishment are also known to prematurely collect patron drinks if the drink is left unattended. Of great concern these days is the mischievous use of narcotics, such as Exstacy, in nightclubs. Allegations of drink tampering cause apprehension by patron to leave drinks unattended. The present inventor recognizes this concern and believes that a beverage container cap would help at least partially address some of the foregoing concerns.

Although prior attempts have been made to provide a combined container opener and container openers that provide aesthetic features that may appeal to the sports industry, a combined beverage container opener and bottled beverage resealer has not been heretofore presented; however, following a teaching of the present invention it should become recognized that the present invention is an ideal solution to many needs associated with the use of beverage containers and enjoyment of beverages contained therein.

SUMMARY OF THE INVENTION

One of the features of the invention is in the provision of a novel, highly simplified, economically manufactured device that greatly facilitates opening of several beverage container types. Another features of the present invention is in the provision of an apparatus that not only covers an opened bottled but also reseal the opening of a bottled beverage container, which is especially useful when a beverage is being used in public environments. Resealing also enables the maintenance of carbonation in a bottle beverage, which can therefore enable a newly opened bottled beverage to be preserved for a much longer period of time after opening than is possible without a resealing feature.

In light of the aforementioned features, it is an aspect of the present invention to provide a beverage container opening device that includes a bottle cap remover module that is generally circular is housing design and includes a circular bottle cap receiver and guide. The circular bottle cap receiver appears in the form of a generally inverted cup and including teeth formed on the inner surface therein adapted to interface with a bottle cap so that the cap can be twisted off of the bottle when a user maneuvers the opener housing. The teeth can be provided in the form of ribs, flutes or ridges. During use, the guide and teeth are received over the cap of a beverage container. The gripping material can extend into and/or downward onto a substantially complimentary surface formed on beverage container caps.

The bottle cap remover module is configured to be integrated into and associated with a three-dimensional decorative housing that can be provided in many forms including the form of miniature headgear (e.g., football helmet, Baseball Cap, Cowboy Hat, Ice Hockey Helmet, Race Car Driver's helmet, baseball batting helmet, motorcycle helmet, top hat, chefs hat, etc.). The decorative housing is operable as a means for the user to firmly grip the combined bottle cap opening module and decorative headgear while opening beverages. The decorative housing serves as a means for a user to control bottle opening functions of the guide and gripping portion by providing sufficient leverage by hand to the guide and gripping portion so that the torque necessary for removing a cap from a beverage container can be achieved even by a person possessing the most modest strength and dexterity.

In accordance with a method of using the twist-off feature of the present invention, the guide and bottle cap opening portions of the bottle cap remover module are received in gripping relation to a standard twist-off bottle cap for its removal from a bottle. There are two standard sizes found on beverage bottles; metallic caps used in association with most beer bottles and plastic caps used with soda and water bottles. The Bottle cap remover module can accommodate both types. It can be appreciated that various sizes of bottle caps can be received by the bottle cap remover module following the present teaching. After firm placement of the decorative housing and the incorporated bottle cap remover module over a bottle cap, the cap can be twisted off of the beverage container. Thus, the decorative cover portion can easily enable a user to place the guide and gripping portion over the top of a beverage provided with a twist-off cap and then the cap can be rotated with the decorative cover portion.

In accordance with another aspect of the invention, concentrically associated with the bottle cap remover module is a bottle opening resealer that can be provided in the form of a rubber cover having a series of flanges and an integrated central extension to facilitate plugging of the opening in a beverage container in a "cork-like" manner (similar in action to that provided by a cork). The rubber flanges, base and cork-like extension jointly operate to seal the opening of a glass beverage bottle (i.e., typically of the beer bottle variety) when the bottle cap remover module is either one of firmly pressed onto or screwed onto the bottle top opening. The bottle opening resealer enables the bottle top to be sealed and retained by the bottle cap opening module, as well as the decorative housing that can be used in association with the bottle cap opening module. Retention is by the interface of the exterior surface of the glass flange formed around the opening of a beverage bottle and at least one of the rubber flanges or metal teeth that interface with the threads formed on or near the glass flange of most U.S. Domestic beer bottle tops.

In accordance with yet another feature of the present invention, the beverage container opening device can be also be provided that includes a "pop-off" bottle cap remover for use with non-threaded bottle caps (i.e., typically found with non-U.S. beer beverage bottle). The bottle cap remover can be in the form of at least one of a twist-off bottle cap remover or a pop-off bottle cap remover and the cover. Preferably both bottle cap removers can be provided in a housing with a cover provided in the form of a bottleneck retainer. Additionally, a pull-tab or can-tab opener can be provided on the same housing.

What is therefore provided is a beverage container opener that can operate as an opener for up to three types of beverage containers (e.g., by removing twist-off bottle caps, removing pop/pull off bottle caps and by manipulating pull tabs on cans), and can also include a bottle opening resealer. The combination of twist-off and pop-off bottle cap remover in a single decorative housing provides opening associated with the bottle cap removers that removal of any bottle cap that may rest within the housing can be easily removed from the housing after removal from a bottle using twist-off caps. The opening is adequate enough to allow a user's thumb, finger or other device access to the guide member to dislodge and remove the cap after its removal from its container.

In accordance with another feature of the present invention, the decorative cover may also be provided with integrated lift tab portion that can facilitate the opening of lift tab devices commonly associated with canned beverages. The decorative cover, otherwise provided in association with the bottle opener, can include a thinly tapered extremity formed on outer end and/or edge of the decorative cover representing the back of headgear or can be formed as a portion of the front "visor portion" of the decorative cover provided in the form of headgear. For example the thinly tapered extremity or modified visor portion should be easily inserted underneath the lift tab element of a beverage can to enable the tab to be raised by a lifting/prying action of the handle. Generally, with the increased force and leverage of the prying handle a tab should be easily lifted and the breaking-away of the opening element of the can accomplished. The lift tab device can also be provided in the form of a metallic wrench-like gripper that can be fastened to the underside of the decorative housing. The metallic wrench-like gripper can be place over a bottle cap by the user and the user can they rotate the housing such that the gripper causes the bottle can to become pried off of the bottle opening. The device should leave any lift projecting upwardly at a convenient angle to be engaged by the fingers to complete the opening. A small narrow extremity or modified visor portion facilitates the initial engagement and raising of the lift tab and enables a broader, tapered portion of the extremity or modified visor to be more easily inserted under the lift tab.

Additionally, it is an advantage of the present invention that the small, narrow extremity or modified visor, referred to above, can also be used to advantage in the opening of milk jugs and like provided with tamper-resistant closures of the type having a pull tab element for releasing the cap for removal. For closures of that type, the extremity or modified visor can be inserted in slot at the end of the closure pull tab. The decorative cover is then handled and/or otherwise manipulated to break the pull tab free from its container. Thereafter, the pull tab can be easily pulled by hand to free the cap.

Another feature of the present invention can enable the opening of pop-off caps typically associated with import beverage containers. In accordance with this feature of the invention, an opening can be formed on the back portion of the decorative cover, which can be associated with the back of headgear such as shown below for a football helmet. Or as a metallic wrench-like gripper that is fastened to the underside of the housing, such as pictured below for the baseball cap and cowboy hat. The opening should preferably be formed to enable the reception of a portion of the pop-off cap and a portion of the bottle it is associated with. Integrated with the opening near an area where the ridge of the cap located between the cap and its bottle, should preferably be formed a tab with tensile strength that is adequate to pry and dislodge the cap from its bottle, causing the cap to "pop off" the bottle.

For a more complete understanding of the above and other features of the invention, reference should be made to the following detailed description of a preferred embodiment of the invention, and to the accompanying drawings.

DESCRIPTION OF THE PREFERRED EMBODIMENT OF THE INVENTION

The present invention is now herein described for the useful provision of a novel, highly simplified, economically manufactured device that facilitates opening of several beverage container types and furthermore, facilitates the security or preservation of beverages in public by serving as a cover for beverages consumed in public.

Figure 1:
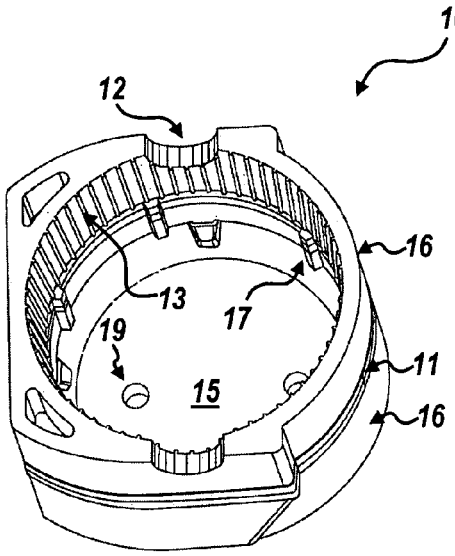
FIG. 1 illustrates the opening in a bottle cap remover module for receiving and removing bottle caps in accordance with the preferred embodiment.
Figure 2:
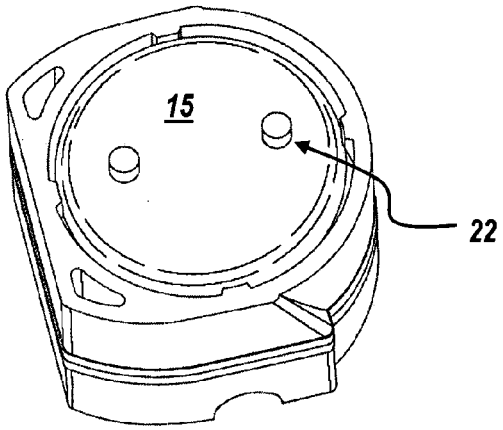
FIG. 2 illustrates the opposite side of the bottle cap remover module shown in FIG. 1, wherein rubber tabs from a bottle opening resealer are received and used to hold the bottle opening resealer in place.

Referring to FIGS. 1 and 2, bottom-side and top-side perspective views of a bottle cap remover module 10 are illustrated in accordance with the features and aspects of the present invention. As shown in the FIGS. 1 and 2, the bottle cap remover module 10 includes a housing 16 adapted with ridges formed along the internal surface of the housing and a metal ring 11 with teeth 17 also incorporated within the internal surface of the housing. The ridges interface with complimentary teeth typically found on the outer surface of plastic soda/water bottle caps and the metallic teeth interface with indentions formed on metallic bottle caps typically found on domestic beer bottle. The bottom surface of the bottle cap remover module 10 has holes 19 for receiving rubber tabs from a bottle opening resealer 20. The rubber tabs 22 of a bottle opening resealer are shown protruding through the holes in FIG. 2. As shown in FIG. 2, notches 12 formed on the ridge of the bottle opening module housing can be formed for placement of a peg or fastener where the housing is to be integrated within a larger decorative housing, as will be further discussed.

Figure 3:
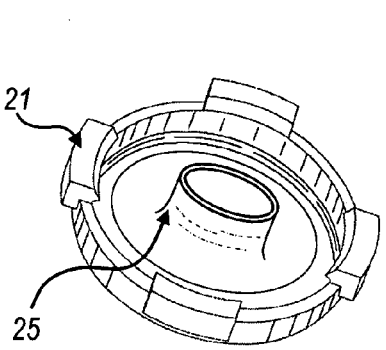
FIGS. 3 and 4 illustrate a bottle opening resealer in the form of a rubber cover having a series of flanges and an integrated cork-like extension. The rubber flanges, base and cork-like extension jointly operate to seal the opening of a glass beverage bottle (i.e., typically of the beer bottle variety) when the bottle cap remover module is either one of firmly pressed onto or screwed onto the bottle top opening.
Figure 4:
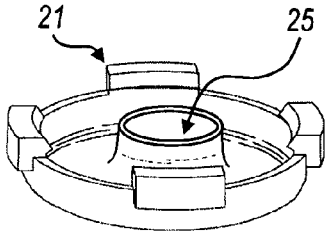
Figure 5:
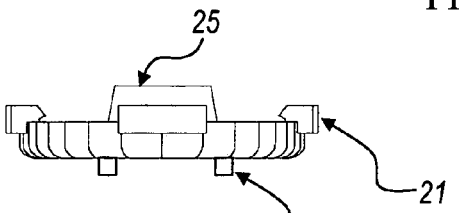
FIG. 5 illustrates a side view of the rubber cover shown in FIGS. 3 and 4, and further illustrate rubber tabs that interface with and are held to the bottom surface of the bottle cap remover module through holes as shown in FIG. 2.

Referring to FIGS. 3-4, a bottle opening resealer 20 in the form of a rubber cover having a series of flanges 21 and an integrated cork-like extension 25. The rubber flanges 21, cork-like extension 25 and the base material connecting them all form the rubber cover and jointly operate to seal the opening of a glass beverage bottle (i.e., typically of the beer bottle variety) when the bottle cap remover module is either one of firmly pressed onto or screwed onto the bottle top opening. FIG. 5 illustrates the rubber tabs that are held within the holes 19 formed within the bottom surface of the bottle cap remover module 10.

The bottle cap remover module 10 can be integrated within a decorative housing. It should be appreciated by those skilled in the art that the present invention is not limited to use of a particular decorative housing, but that the housing should enable the user to manipulate the bottle cap remover module 10 about a beverage bottle. The housing can be made to take the form of, for example, baseball caps, cowboy hats and numerous other trade-related or casual headgear or head covers that can be imagine by skilled artisans (e.g., construction hard hats, space helmets, military headgear, cultural head covers). Whatever the design choice for the housing, it should serve as an adequate means for a user to control bottle opening functions and provide sufficient leverage to most any user so that torque necessary for removing a cap or manipulating a tab from a beverage container can be achieved even by a person possessing the most modest strength and dexterity. It is preferred that the decorative housing be appealing to a vast number of consumer, because decorative housings in the form of miniature headgear (e.g., football helmet, Baseball Cap, Cowboy Hat, Ice Hockey Helmet, Race Car Driver's helmet, baseball batting helmet, motorcycle helmet, top hat, chefs hat, etc.) is believed by the present inventor to have the most marketing and advertising appeal.

Figure 6:
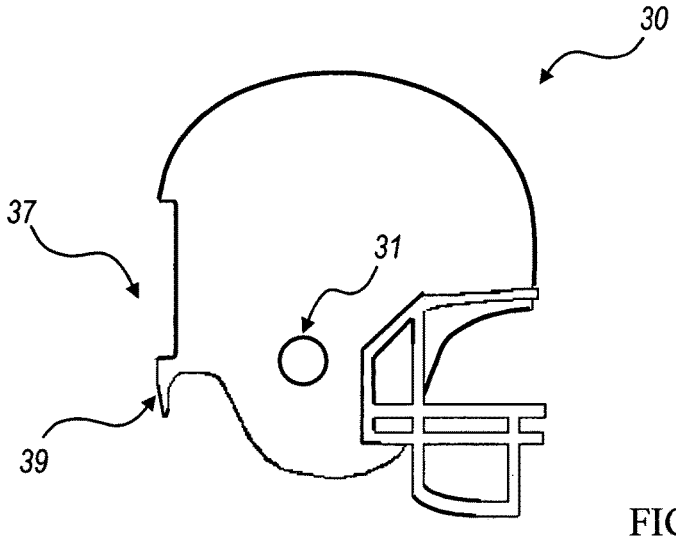
FIGS. 6-8 illustrates side and bottom views of a decorative housing within which the bottle cap remover module can be integrated, the decorative housing without intending limitation being shown in the form of a football helmet.
Figure 7:
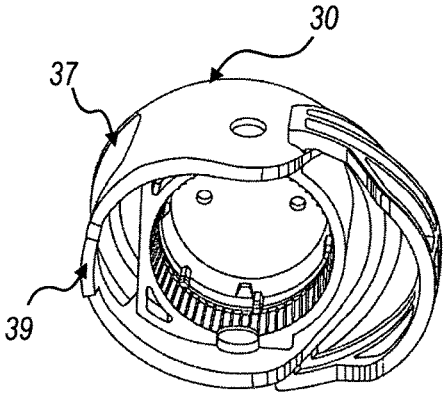
Figure 8:
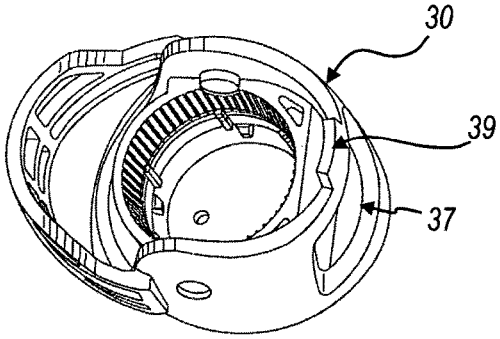
Figure 9:
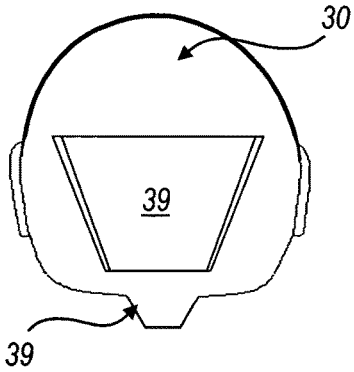
FIG. 9 illustrates a rear view of a decorative housing shown in FIGS. 6-8, the rear illustration also showing an integrated pop-off bottle cap remover.

Referring to FIGS. 6-9, a decorative housing 30 is shown in the form of a football helmet. FIG. 6 illustrates a notch 31 wherein a round peg (not shown) can be inserted to hold the bottle cap remover module in place within the decorative housing 30. The peg will hold the housing by the notches 12 discussed with respect to FIG. 1. A peg 33 is shown in FIG. 7 holding the bottle cap remover module 10 in place within the housing 30. FIG. 8 illustrates another perspective of the housing and bottle cap remover module 10 integrated therein as it is held in place by peg 31. A notch 37 is shown formed in the backside of the housing 30. The notch can be used to remove pop-off bottle caps from bottles. Bottle caps are removed after they are received by the notch 37 and the notch is rotated to cause the cap to become lodged within the notch 37 and they pried off of the bottle by user force over the housing 30. A metal tab 39 is also shown located on the bottom ridge of the housing 30. The tab 39 can be used to pry can tabs from a canned beverage. The can tab is lifted and pried away from the can as a user rotates the housing 30.

Figure 10:
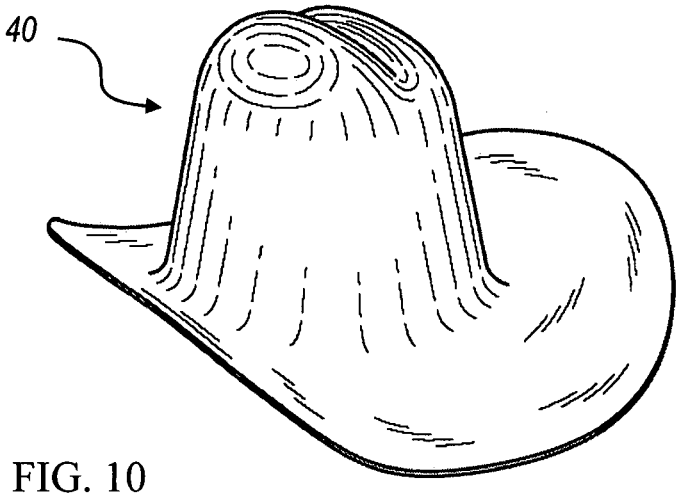
FIG. 10 illustrates perspective view of a decorative housing within which the bottle cap remover module can be integrated, the decorative housing without intending limitation being shown in the form of a cowboy hat.
Figure 11:
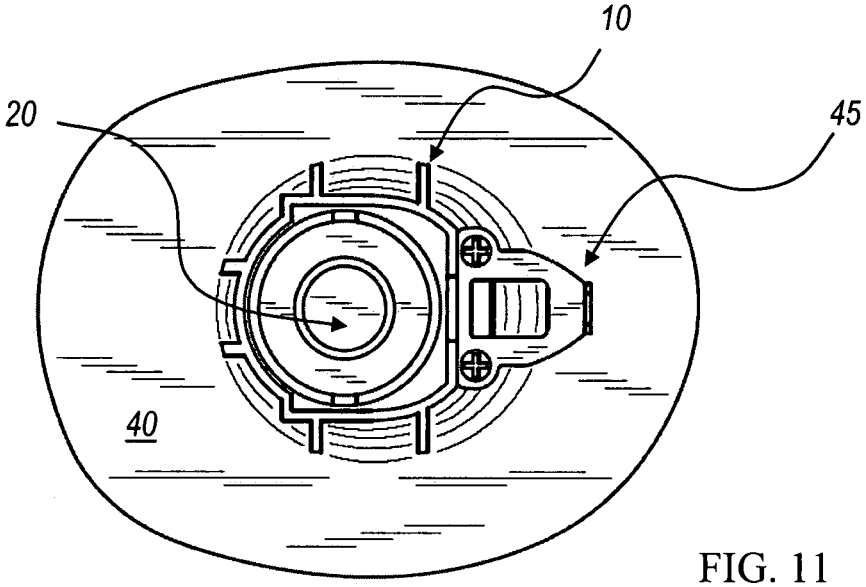
FIG. 11 illustrates a bottom view of the decorative housing shown in FIG. 10, the view also showing bottle cap remover module hardware incorporated into/onto the housing.

Referring to FIGS. 10 and 11, a decorative housing 30 is shown in the form of a cowboy hat 40. FIG. 10 illustrates a perspective view of the decorative housing 40. FIG. 11 illustrates the bottom view of the housing wherein the bottle cap remover module 10 is integrated and whereon a pop-off bottle cap hardware 45 is also shown attached to the decorative housing's 40 underside. The resealer 20 is also shown integrated within the bottle cap remover module 10. The pop-off bottle cap hardware 45 is shown fastened to the bottom surface of the housing 40 with screws, although other means of fastening can be appreciated (e.g., glue).

Figure 12:
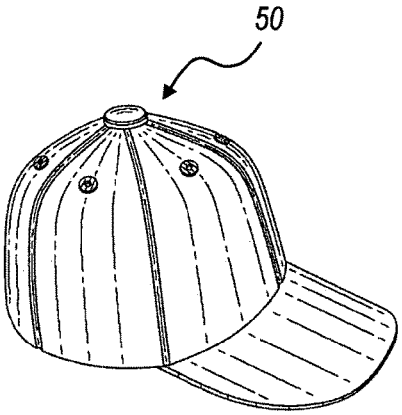
FIG. 12 illustrates perspective view of a decorative housing within which the bottle cap remover module can be integrated, the decorative housing without intending limitation being shown in the form of a baseball cap.
Figure 13:
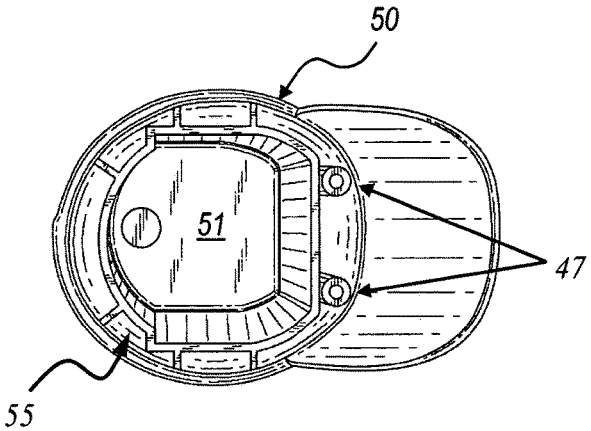
FIG. 13 illustrates a bottom view of the decorative housing shown in FIG. 12, the view also showing interior molding surfaces of the housing into/onto which bottle cap remover module hardware can be incorporated.

Referring to FIGS. 12-16, another decorative housing 30 is shown in the form of a baseball cap 50. FIG. 12 illustrates a perspective view of the decorative housing 50. FIG. 13 illustrates a bottom view of the decorative housing 50 wherein interior bottom surface 51 of the housing 50 and screw mounts 47 are shown. The interior surface 51 define the shape of the bottle cap remover module 10 as shown by the ridgeline 55 along the bottom surface.

Figure 14A:
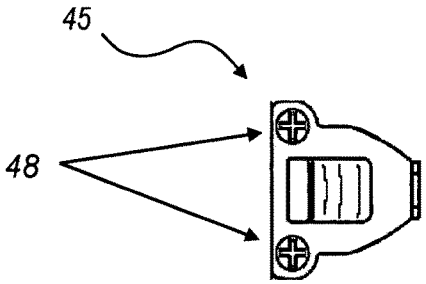
FIG. 14A illustrates a bottom view of pop-off bottle cap opening hardware that can be incorporated onto the bottom surface of decorative housing.
Figure 14B:
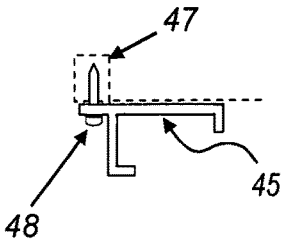
FIG. 14B illustrates a side view of pop-off bottle cap opening hardware that can be incorporated onto the bottom surface of decorative housing.

Referring to FIGS. 14A and 14B, pop-off bottle hardware 45 is illustrates. FIG. 14A illustrates the bottom view of the pop-off bottle hardware 45, while FIG. 14B illustrates a side view of the pop-off bottle hardware 45 mounted by a screw 48 onto the screw mounts 47 also shown in FIG. 13.

Figure 15:
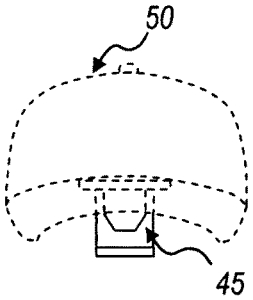
FIG. 15 illustrates a front view of pop-off bottle cap opening hardware shown in FIGS. 14A and 14B, the hardware incorporated onto the bottom surface of decorative housing in the form of a baseball cap.
Figure 16:
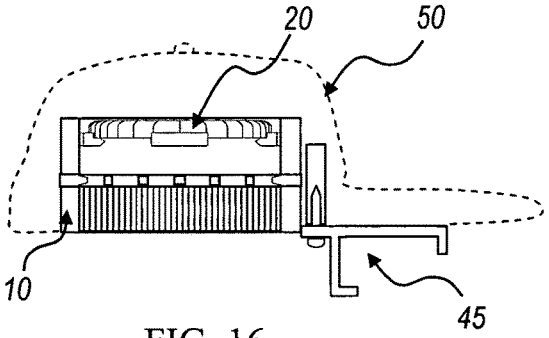
FIG. 16 illustrates a cross sectional side view of pop-off bottle cap opening hardware shown in FIGS. 14A and 14B, the hardware incorporated onto the bottom surface of decorative housing in the form of a baseball cap.

FIG. 15 illustrates a frontal view of a phantom baseball cap as the decorative headgear 50 and a front perspective pop-off bottle hardware shown located at the bottom surface of the housing 50. FIG. 16 illustrates a cross sectional view of the decorative housing 50 and bottle cap removal and bottle resealer hardware integrated within the housing 50. FIG. 16 illustrates the bottle cap removing module 10, resealed 20 and pop-off bottle cap remover 45 as it would preferably be located within the housing 50.

It should be appreciated that the present invention can include at least one bottle-cap remover and an opened bottle resealer that can be used in a manner wherein it is presented in the form of a bottleneck retainer. It should be appreciated that portions of the multi-purpose opening device of the invention advantageously can be made in the form of a unitary, injection molded plastic device of a suitable structural plastic or rubbery material, such as ABS. It should also be appreciated that portions or the entire device can be formed in aluminum, plastics, metal, or other alloy that supports a rigid sturdy construction in light of the intended uses for the present invention. The bottle retaining portion will preferably be made of a flexible material, which, like or if rubber, will allow the device to remain attached to the neck of a bottle for selective removal by a user/owner of the bottle.

The device of the invention, although having multiple advantageous uses, is simple and compact, and is easily and inexpensively manufactured. It is thus ideally suited for the end use intended. Because of its simplicity, compactness, and low cost, the device of the invention can be ubiquitously utilized as a kitchen appliance, camping and picnicking utensil, advertising and promotional item, personal safety device in public gathering places, novelty item, etc.

It should be understood, of course, that the specific form of the invention herein illustrated and described is intended to be representative only as certain changes may be made therein without departing from the clear teachings of the disclosure. Accordingly, reference should be made to the following appended claims in determining the full scope of the invention.

I claim:

1. A beverage container opening device, comprising:

a decorative housing provided in the form of miniaturized three-dimensional headgear representative of headgear that can be worn by humans including a bottom, top, front, back, and sides, said decorative housing having an opening formed in its bottom and including a retention mechanism integrated within said decorative housing for retaining a bottle cap remover module; and a bottle cap remover module further comprising:

(a) a generally circular housing including a circular bottle cap receiver and guide having an inner surface;

(b) teeth in the form of of ribs, flutes or ridges formed on the inner surface, wherein during use of the beverage container opening device, the guide and teeth are received over the cap of a beverage container whereon the teeth lay substantially complimentary to ridge shaped surfaces also formed on beverage container caps;

(c) a rubber bottle resealer and retaining device further comprising at least one flange, said rubber bottle opening resealer and retaining device integrated within said bottle cap remover module, wherein said rubber bottle resealer and retaining device enables said decorative housing to operate in sealing and covering a bottle opening when said at least one flange is placed over a bottle opening and engages with a glass flange formed on the bottle; and a pop-off bottle cap remover formed on said decorative housing.

2. The device of claim 1, wherein the decorative miniature housing is provided in the form of at least one of a: football helmet, baseball cap, cowboy hat.

3. The opening device according to claim 2, further comprising:

a can tab opener formed on said decorative housing.

4. The opening device according to claim 1, further comprising:

a can opener formed on said decorative housing.

5. A beverage container opener, resealer and cover, comprising:

(a) a decorative housing provided in the form of miniaturized three-dimensional headgear representative of headgear that can be worn by humans, said miniaturized three-dimensional headgear including a bottom, top, front, back, and sides, said decorative housing having an opening formed in its bottom and including a retention mechanism integrated within said decorative housing for retaining a bottle cap remover module;

(b) a bottle cap remover module integrated within said housing further comprising:

(i) a bottle cap remover module having a generally circular housing including a includes a circular bottle cap receiver and guide having an inner surface;

(ii) teeth in the form of at least one of ribs, flutes or ridges formed on the inner surface, wherein during use of the beverage container opening device, the guide and teeth are received over the cap of a beverage container whereon the teeth lay substantially complimentary to ridge shaped surfaces also formed on beverage container caps; and (iii) a rubber bottle opening resealer and retaining device further comprising at least one flange, said rubber bottle opening resealer and retaining device integrated within said bottle cap remover module, wherein said rubber bottle resealer and retaining device enables said decorative housing to operate in sealing and covering a bottle opening when said at least one flange is placed over a bottle opening and engages with a glass flange formed on the bottle;

a can tab opener formed on said decorative housing; and a pop-off bottle cap remover formed on said decorative housing.

6. A beverage container opening device, comprising:

a decorative housing provided in the form of miniaturized three-dimensional headgear representative of headgear that can be worn by humans and including at least one of a: football helmet, baseball cap, cowboy hat, said decorative housing including a bottom, top, front, back, and sides, said decorative housing having an opening formed in its bottom and including a retention mechanism integrated within said decorative housing for retaining a bottle cap remover module;

a bottle cap remover module further comprising:

(a) a generally circular housing including a circular bottle cap receiver and guide having an inner surface;

(b) teeth in the form of ribs, flutes or ridges formed on the inner surface, wherein during use of the beverage container opening device, the guide and teeth are received over the cap of a beverage container whereon the teeth lay substantially complimentary to ridge shaped surfaces also formed on beverage container caps; and (c) a rubber bottle resealer and retaining device further comprising at least one flange integrated within said bottle cap remover module, wherein said rubber bottle resealer and retaining device including said at least one flange enables said decorative housing to operate in sealing and covering a bottle opening when the rubber bottle resealer and retaining device and at least one flange are placed over a bottle opening and engage with a glass flange formed on the bottle; and a pop-off bottle cap remover formed on said decorative housing.

7. The opening device according to claim 6, further comprising a can opener formed on said decorative housing.

* * * * *